United States Patent [19]

Smith, Jr. et al.

[11] 4,445,944

[45] May 1, 1984

[54] HEAT TREATMENTS OF LOW EXPANSION ALLOYS

[75] Inventors: Darrell F. Smith, Jr.; Edward F. Clatworthy, both of Huntington, W. Va.

[73] Assignee: Huntington Alloys, Inc., Huntington, W. Va.

[21] Appl. No.: 302,975

[22] Filed: Sep. 17, 1981

[51] Int. Cl.[3] ..... C21D 7/14; C22F 1/10

[52] U.S. Cl. ..... 148/12.3; 148/12.7 R; 148/12.7 N; 148/31; 148/142; 148/158; 148/162; 148/409; 148/410; 148/419

[58] Field of Search ..... 148/162, 158, 32.5, 148/31, 142, 12.3, 12.7 R, 12.7 N; 75/122, 134 F, 170

[56] References Cited

U.S. PATENT DOCUMENTS 4,200,459 4/1980 Smith, Jr. et al. ..... 75/134 F

*Primary Examiner*—R. Dean

*Attorney, Agent, or Firm*—Miriam W. Leff; Ewan C. MacQueen; Raymond J. Kenny

[57] ABSTRACT

Directed to an overaging heat treatment applied to age-hardenable nickel-cobalt-iron controlled expansion alloys so as to contribute high notch strength at temperatures on the order of about 1000° F. thereto.

18 Claims, No Drawings

HEAT TREATMENTS OF LOW EXPANSION ALLOYS

The invention is directed to a heat treatment method for application to age-hardenable controlled expansion alloys which provide adequate tensile strength together with required notch strength at temperatures on the order of 1000° F.

BACKGROUND OF THE INVENTION AND THE PRIOR ART

Controlled expansion alloys are useful in many applications, most of which, to date have not represented major markets for metal. For example, the Eiselstein and Bell, U.S. Pat. No. 3,157,495 is directed to a nickel-cobalt-iron alloy having controlled thermo-elastic properties up to elevated temperatures. The alloys provided in accordance with this patent are age-hardenable and develop excellent strength and ductility values at ordinary temperatures. In addition, the alloys were found to have highly useful strength properties at elevated temperatures and had long rupture lives at temperatures up to 1000° F. although quite low ductility in properties were then observed.

U.S. Pat. No. 3,705,827 reports on a heat treatment procedure for heat treating age-hardenable chromium-free and chromium-containing nickel-iron alloys. Development of high strength in the age-hardenable alloys together with useful rupture life at temperatures on the order of 1150° F. are reported in this patent.

U.S. Pat. No. 4,006,011 is directed to an essentially chromium-free, age hardenable, nickel-cobalt-iron alloy capable of providing high strength at ordinary temperatures and having useful stress rupture properties at certain elevated temperatures, such as 1150° F.

Recently, an interest has been expressed in alloys having controlled expansion characteristics up to temperatures in the order of 1000° F. or 1100° F. Thus, it has been considered that various parts used in aircraft gas turbine engines, such as rings, seals, casings, nozzle supports, etc. could usefully be produced of nickel-iron or nickel-cobalt-iron alloys having controlled expansion characteristics even though the alloys are ordinarily regarded as being deficient in oxidation resistance in oxidizing atmospheres at temperatures encountered in the hot zones of aircraft gas engines. Further pursuit of the requirements properly to be imposed upon such alloys in aircraft gas engine applications has developed the fact that the alloys and the heat treatments therefore which have been provided to data are still subject to deficiencies, namely inadequate notch strength at temperatures on the order of 1000° F. Thus, even the alloys provided in accordance with the teachings of U.S. Pat. No. 4,200,459 which are nickel-iron-cobalt alloys having controlled low aluminum contents were still deficient in notch strength at temperatures of 1000° F. or thereabouts when subjected to the age-hardening treatment schedules disclosed.

Progress in the development of the alloys have now lead to heat treatments applicable to alloys such as those disclosed in U.S. Pat. No. 4,200,459 which are capable of rendering the alloys in a condition wherein they have adequately high tensile strength and ductility together with adequately high notch strength at the temperatures of interest to aircraft designs, e.g., 1000° F.

SUMMARY OF THE INVENTION

The invention is based on the discovery that certain heat treating sequences involving a solution treatment, an intermediate temperature treatment and an aging treatment can provide overaged structures in age-hardenable nickel-cobalt-iron controlled-expansion alloys whereby combinations of properties including short time strength and ductility and elevated temperature notch strength can be provided therein.

DETAILED DESCRIPTION OF THE INVENTION

The invention is directed to heat treatments applicable to age hardenable nickel-cobalt-iron alloys containing about 34% to about 45% or 55% nickel, about 5% to about 25% cobalt, about 1% to about 2% titanium, about 1.5% to about 5.5% columbium, not more than about 0.2% aluminum, up to about 0.1% carbon and the balance is essentially iron. The alloy may contain about 20% to 55% iron and 10% or more of cobalt, e.g., 12% to 16% cobalt. Tantalum may be substituted for columbium on the basis of two parts tantalum for each part of columbium, by weight. Optionally, the alloy may contain up to about 1% vanadium and up to about 2% hafnium.

Incidental elements, e.g., deoxidizers, malleabilizers, scavengers and tolerable impurities may be present in amounts inclusive of up to about 0.01% calcium, up to 0.01% magnesium, up to 0.03% boron, up to 0.1% zirconium, up to 0.5% silicon and up to about 1% each of copper, molbdenum and tungsten. Sulfur and phosphorous are undesirable and usually restricted to no more than about 0.015% individually. The balance of the composition is iron. The compositions of the alloys in respect of iron-cobalt-nickel and age-hardening elements is controlled as shown in U.S. Pat. No. 4,200,459 (the disclosure of which is incorporated herein by reference) to provide the desired thermal co-efficient of expansion and inflection temperature.

The alloys of the invention are provided in wrought form, such as strip, sheet, rings and the like. The heat treatments in accordance with the invention comprise a solution treatment which is usual in heat treating age-hardenable nickel-base alloys, an intermediate temperature treatment followed by a lower aging temperature exposure. This can be accomplished by e.g., air cooling after the intermediate temperature exposure then employing a two step aging treatment or by controlled cooling, e.g., directly furnace cooling, to the lower aging temperature. Controlled cooling as used herein refers to cooling at a rate of about 20° F. to 200° F. per hour. Solution heat treatments will range between about 1650° F. and 1925° F. The intermediate temperature treatment will be in the range of about 1375° F. to about 1550° F. and the lower aging heat treatment will be normally at a temperature of about 1300°-1400° F. for about 8 hours followed by furnace cooling to about 1000° F. to 1200° F. for about 8 hours in the case of the three step treatment. Alternatively, the alloy may be cooled at a controlled rate, e.g., 20° F. to 200° F. per hour directly from the intermediate temperature to a temperature at least 100° F. therebelow, e.g., about 1100° F. to 1200° F. for the two step age.

As is common in the treatment of age-hardenable nickel-base alloys, solution treatment may not be conducted for a longer period of time than is necessary to dissolve the age-hardening components in the metal matrix. Usually about 1 hour of thorough heating of the part being heat treated is sufficient as a solution treating time.

The time employed for the intermediate treatment can vary considerably, with the treatment being upwardly graduated in both temperature and time as the annealing temperature is increased. Of course, for economic operation it is desirable that the heat treatment be as short as possible. It is to be appreciated that the recrystallization temperature for alloys to be heat treated in accordance with the invention is approximately 1675° F. to 1725° F. with the actual temperature at which recrystallization occurs being dependent upon composition and thermal mechanical processing history.

It should be appreciated that the best strength properties are obtained when the solution treating temperature is about 1650° F. This is a temperature safely below the recrystallization temperature for alloys defined herein. However, in respect of parts which must be brazed, higher solution treating temperatures are required. When such is the case, the solution treating temperature will be above the recrystallization temperature for the alloy. It is, of course, recognized that excess grain growth as a result of exposure at the solution treating temperature is undesirable. The heat treatments accomplished in accordance with the invention are essentially overaging treatments and it is to be appreciated that the heat treatments described herein provide tradeoffs in properties. Thus, in order to obtain the designed required notch strength, it is necessary to heat treat the alloy by overaging such that the optimum short term strength and ductility values may not be and usually will not be obtained. The treatments in accordance with the invention give overaged structures with improved resistance to oxidation related rupture failures.

Contrarywise, it is found that in the alloys treated in accordance with the invention, heat treatments which provide the highest short time strength and ductility, generally provide inadequate notch strength at elevated temperatures especially in the critical temperature region around 1000° F.

The age-hardenable controlled expansion alloys heat treated in accordance with the invention will generally obtain a notched bar rupture life of at least about 100 hours at 1000° F. and a stress of 100 ksi.

In the following Table I, three heat treatment sequences are shown as examples in accordance with the invention.

TABLE I

| Condition | Annealed | Aged |
|---|---|---|
| B | 1650° F./1 h air cooled | 1400° F./8 h, furnace cooled to 1150° F./8 h, air cooled |
| C | 1800° F./1 h air cooled | 1425° F./12 h, furnace cooled to 1150° F./8 h, air cooled |
| D | 1900° F./1 h air cooled | 1475° F./16 h, furnace cooled to 1150° F./8 h, air cooled |

Of the foregoing treatments, Condition D is applied in applications in which brazing is required. Condition B provides optimum transverse rupture strength. Condition C provides a fine grain recrystallized structure with good stress rupture strength.

It has been found that the heat treated alloy is extremely sensitive to the testing direction. Thus, testing in the longitudinal direction is usually most beneficial for the purpose of reporting high properties. However, in the same bar or in material from which the bar was taken, if the test orientation is in a transverse direction, greatly inferior properties can be obtained. Since one application envisioned for the alloy is a large ring which is produced by rolling, the long transverse direction is the direction in the surface of the ring taken perpendicular to the circumference whereas the short transverse direction is taken in the thickness of the ring moving along a radius. Testing in the short transverse direction is particularly sensitive.

Some examples may now be given.

EXAMPLE 1

Six commercial size heats (Alloys 1 through 6) of the alloy of the invention were prepared together with three laboratory size heats (Alloys 7 through 9). The compositions of which are given in Table II.

The commercial scale heats each were prepared using the vacuum induction plus vacuum arc remelting process.

Hot rolled products including flats, ¾" thick by 5" wide were prepared.

The laboratory scale melts were prepared by vacuum induction melting.

Hot rolled flat from melt No. 2 was used as material for a series of tests including room temperature tensile, in the long transverse direction. The stress rupture testing at 1150° F. and 110 ksi in the longitudinal and in the long transverse direction and stress rupture testing at 1000° F. and 110 ksi in the long direction and in the long transverse direction.

A combination of smooth and notch bar was used in the testing. The smooth test section was 0.178" diameter by 0.715" gage length with a notch section shoulder diameter of 0.250" containing an annular notch of 0.178" diameter and a root radius of 0.006", resulting in a stress concentration factor of ($K_t$) of 3.6.

The results of the testing together with the heat treatments employed are shown in the following Table III. From the Table it is to be seen that the heat treatment which produced the highest room temperature strength and ductility provided inferior properties when tested at 1000° F. and 110 ksi in the stress rupture test with failure occurring in the notch. The data shown wherein the intermediate aging temperature was 1325° F. indicated high room temperature tensile properties, relatively satisfactory life in the stress rupture testing at 1150° F. and 110 ksi but with notch failures in the stress rupture testing at a 1000° F. and 110 ksi.

It was only when the intermediate aging temperature was increased to 1400° F. for 8 h as shown in Table III that adequate life in these stress rupture tests was provided with failure in the smooth bar portion of the test specimen. While only 5% elongation was reported in the test this was regarded as satisfactory for the applications contemplated. The room temperature properties in this heat were lower than found for intermediate temperature heat treatments at lower temperatures but are still high and adequate for the intended use.

EXAMPLE 2

Material from the three laboratory heats in the form of 9/16" by 4" hot rolled flat was heat treated and subjected to stress rupture testing at 1000° F. and 110 ksi using the combination bar. The results are shown in the following Table IV. In each case, the treatment after the anneal which is shown in Table IV consisted of an intermediate temperature treatment at 1400° F. for 8 h with the furnace cool at a rate of 100°/h to 1150° F., a hold for 8 h followed by air cooling.

As shown in Table IV, the 1650° anneal gives much longer life than the 1700° anneal. Furthermore, failures of these specimens given the 1700° anneal occurred in the notch.

EXAMPLE 3

Material from Alloys 1, 3, 4, 5 and 6 was converted to 9/16 inch diameter hot rolled round. Properties were determined at room temperature, and 1000° F. using separate smooth bar tensile specimens. Rupture properties were determined at 1000° F. using 0.178" diameter smooth bar specimens and double shanked notch bar specimens having a $K_t$ of 2 (0.250" diameter notch, 0.0363" root radius and a shoulder diameter of about 0.350"). The results are shown in Tables V and VI.

EXAMPLE 4

Six laboratory scale melts (Alloys A, B, C and 10, 11, and 12) were made having the compositions shown in Table VII. Material from those heats was converted to 9/16 inch diameter hot rolled bar, and was heat treated as shown in Table VIII. High aluminum alloys A, B and C are outside of the invention. The heat treated bar stock in the form of smooth bar and notch bar specimens ($K_t$=2) was rupture tested at 1000° F. with results shown in Table VIII. It was concluded that in alloys of the invention, boron was not helpful when high temperature anneals are used. It appears there is interaction between heat treatment and compositional factors.

TABLE II

| | Chemical Analyses, % Wt | | | | | | | | | | | | | | | | |
|---|---|---|---|---|---|---|---|---|---|---|---|---|---|---|---|---|---|
| Alloy No. | C | Mn | Fe | S | Si | Cu | Ni | Cr | Al | Ti | Co | Mo | Cb + Ta | B | P | Ca | Zr |
| 1 | .02 | .04 | Bal | .006 | .04 | .01 | 37.40 | .05 | .02 | 1.57 | 14.32 | .01 | 4.64 | .008 | .005 | .003 | — |
| 2 | .02 | .04 | Bal | .007 | .03 | .01 | 37.44 | .04 | .02 | 1.51 | 14.53 | .01 | 4.73 | .008 | .003 | .002 | — |
| 3 | .02 | .06 | Bal | .008 | .09 | .04 | 37.18 | .07 | .08 | 1.57 | 14.32 | .01 | 4.67 | .011 | .004 | .001 | — |
| 4 | .03 | .06 | Bal | .003 | .10 | .21 | 37.36 | .11 | .04 | 1.58 | 14.27 | .03 | 4.58 | .005 | .006 | .001 | — |
| 5 | .02 | .05 | Bal | .004 | .11 | .08 | 37.44 | .09 | .05 | 1.57 | 14.40 | .04 | 4.72 | .006 | .008 | .001 | — |
| 6 | .02 | .05 | Bal | .005 | .12 | .08 | 37.44 | .09 | .05 | 1.58 | 14.40 | .04 | 4.72 | .006 | .008 | .001 | — |
| 7 | .02 | .11 | Bal | .003 | .13 | .02 | 37.81 | .19 | .04 | 1.49 | 13.59 | — | 4.65 | .0014 | — | .008 | — |
| 8 | .02 | .10 | Bal | .003 | .12 | .01 | 37.34 | .16 | .04 | 1.26 | 14.44 | — | 4.57 | .008 | — | .005 | .003 |
| 9 | .01 | .11 | Bal | .002 | .14 | .01 | 37.42 | .17 | .03 | 1.32 | 14.25 | — | 4.55 | .0016 | — | .005 | <.001 |

TABLE III

Effect of Heat Treat, Test Temp & Test Orientation On Room Temperature Tensile Strength
And Combination Bar Rupture Strength
Melt: Alloy 2
Product: ¾" × 5" FHAR

| | | | 1150° F./110 ksi | | | | 1000° F./110 ksi | | | |
|---|---|---|---|---|---|---|---|---|---|---|
| Heat Treatment | RTT Long Trans | | Long | | Long-Trans | | Long | | Long Trans | |
| 1700° F./1 hr, AC | 0.2% YS (ksi): | 165.5 | | | | | | | Life (hrs): | 7.9 |
| 1250°/8 hr | TS (ksi): | 204.5 | | | | | | | El (%): | Notch |
| FC (100/hr) | El (%): | 12. | | | | | | | RA (%): | Failure |
| 1150°/8 hr, AC | RA (%): | 25. | | | | | | | | |
| 1700° F./1 hr, AC + | 0.2% YS (ksi): | 138. | Life (hrs): | 114.6 | Life (hrs): | 67.8 | Life (hrs): | 204.9 | Life (hrs): | 24.5 |
| 1325°/8 hr | TS (ksi): | 179.5 | El (%): | 13. | El (%): | 10. | El (%): | Notch | El (%) | Notch |
| FC (100/hr) | El (%): | 12. | Ra (%): | 21.5 | RA (%): | 20.5 | RA (%): | Failure | RA (%): | Failure |
| 1150°/8 hr, AC | RA (%): | 24. | | | | | | | | |
| 1700° F./1 hr, AC + | 0.2% YS (ksi): | 132. | | | | | | | Life (hrs): | 1121.7(1) |
| 1400°/8 hr | TS (ksi): | 174. | | | | | | | El (%): | 5. |
| FC (100/hr) | El (%): | 12. | | | | | | | RA (%): | 24. |
| 1150°/8 hr, AC | RA (%): | 22. | | | | | | | | |

(1)Stress inc. to 120 ksi @ 1000 hrs - 130 ksi @ 1100 hrs.

TABLE IV

Effect of Anneal on 1000°/110 ksi
Combination Bar Rupture
Product/Size: 9/16" × 4" FHAR
Test Orient: Long-Trans
*Heat Treatment: Ann (As Shown)/1 hr, AC + 1400°/8 hr FC 100°/hr to 1150° F./8 hr, AC

| Alloy No. | *Heat Treatment | Life Hrs. | El % | RA % |
|---|---|---|---|---|
| 7 | 1650/1, AC + Age | 1462.5 | 6. | 6. |
| | 1700/1, AC + Age | 25.5 | NOTCH | |
| 8 | 1650/1, AC + Age | 2185 | | |
| | 1700/1, AC + Age | 162.7 | NOTCH | |
| 9 | 1650/1, AC + Age | 1877.5 | 6. | 7. |
| | 1700/1, AC + Age | 22.3 | NOTCH | |

TABLE V

Effect of Aging Treatment on RT and 1000° F. Tensile
Product: 9/16" ϕ Hot Rolled Round

| | | RTT | | | | 1000° F. HTT | | | |
|---|---|---|---|---|---|---|---|---|---|
| Heat Treatment °F./hr | Alloy Code | 0.2% YS ksi | TS ksi | El % | RA % | 0.2% YS ksi | TS ksi | El % | RA % |
| Two-Step Ages** | | | | | | | | | |
| 1800/1, AC + 1425/12 FC | 5 | 124.5 | 179.5 | 15. | 21. | 115.5 | 157.5 | 17.5 | 40. |
| | 6 | 124. | 178.5 | 15. | 20.5 | 108.5 | 151.5 | 18. | 44. |
| 1475/8 FC | 5 | 117. | 179. | 15. | 18.5 | 105. | 156. | 18.5 | 41. |
| | 6 | 117. | 179. | 14. | 18.5 | 106.5 | 154.5 | 18. | 41. |
| 1475/12 FC | 5 | 105. | 172. | 14. | 15. | 95. | 148. | 20. | 42. |
| | 6 | 107. | 170.5 | 14. | 15. | 95.5 | 144. | 21.5 | 46. |

TABLE V-continued

Effect of Aging Treatment on RT and 1000° F. Tensile
Product: 9/16" ϕ Hot Rolled Round

| Heat Treatment °F./hr | Alloy Code | RTT 0.2% YS ksi | RTT TS ksi | RTT El % | RTT RA % | 1000° F. HTT 0.2% YS ksi | 1000° F. HTT TS ksi | 1000° F. HTT El % | 1000° F. HTT RA % |
|---|---|---|---|---|---|---|---|---|---|
| 1900/1, AC + | | | | | | | | | |
| 1475/12 FC | 1 | — | — | — | — | 93.8 | 151. | 17. | 35. |
| | 4 | 119.5 | 186.5 | 6.5 | 13. | 107. | 153.5 | 18.5 | 37. |
| | 5 | 117. | 176.5 | 9. | 9.5 | 102.5 | 152.5 | 18. | 27. |
| | 6 | 116. | 177.5 | 9. | 8.* | 96. | 150.5 | 18. | 34. |
| 1475/16 FC | 1 | — | — | — | — | 89.4 | 150. | 19. | 35. |
| | 3 | — | — | — | — | 87.7 | 144. | 19.5 | 37. |
| | 4 | 119.5 | 169.5 | 6.5 | 13. | 93.5 | 151.5 | 19. | 31. |
| | 5 | 107.5 | 165.5 | 9. | 9.5 | 92. | 143. | 19.5 | 37. |
| | 6 | 107. | 167.5 | 9. | 10.5 | 90.5 | 143. | 20. | 37. |
| Three-Step Ages*** | | | | | | | | | |
| 1900/1, AC + | | | | | | | | | |
| 1475/12, A | 1 | — | — | — | — | 98.9 | 151.5 | 17. | 32. |
| | 4 | 121.5 | 172.5 | 6.5 | 12. | 105. | 149. | 17.5 | 33. |
| | 5 | 110.5 | 170 | 11. | 12. | 94. | 148. | 16.5 | 27. |
| | 6 | 111.5 | 169.5 | 11. | 10.5 | 98.1 | 149. | 17.5 | 36. |
| 1475/16, A | 1 | — | — | — | — | 90.7 | 146. | 18. | 36. |
| | 3 | — | — | — | — | 86.9 | 143.5 | 19. | 38. |
| | 4 | 116. | 164. | 6.5 | 11.5 | 95.4 | 147. | 17. | 32. |
| | 5 | 105.5 | 162. | 10. | 10. | 93.5 | 146. | 18. | 36. |
| | 6 | 106.5 | 165. | 9. | 11. | 87. | 139. | 20. | 38. |

*Broke on Punch Mark
**Aged at Temp/Time Shown Furnace Cooled 100° F./hr to 1150° F./8 hr, AC
***Aged at Temp/Time Shown Air Cooled Plus 1325° F./8 hr FC (100°/hr) to 1150°/8 hr, AC

TABLE VI

Effect of Aging Treatment on 1000° F./120 ksi Stress Rupture
Product: 9/16" ϕ Hot Rolled Round

| Heat Treatment °F./hr | Alloy No. | SBL Hrs. | El % | RA % | NBL ($K_t$ = 2) Hrs. |
|---|---|---|---|---|---|
| Two-Step Ages** | | | | | |
| 1800/1, AC + | | | | | |
| 1425/12 FC | 5 | 753.5 | 3.5 | 4. | 397.7 N |
| | 6 | 825.6 | 4. | 1. | 1103.3 N |
| 1475/8 FC | 5 | 1053.0(6) | — | — | 1060.2 N(5) |
| | 6 | 502.1 | 4. | 6. | 1110.6 N |
| 1475/12 FC | 5 | 489.8 | 5.5 | 7. | 492.2 N |
| | 6 | 93.9 | 7.5 | 14. | 1129.9 N |
| 1900/1, AC + | | | | | |
| 1475/12 FC | 1 | 139.2 | 4.5 | 5. | 45.5 N |
| | 3 | — | — | — | 67.2 SL |
| | 4 | 108.7 | BIT(1) | — | 40.5 N |
| | 5 | 186.9 | BIT | — | 124.7 N |
| | 6 | 749.8 | 5. | 9. | 118.8 N |
| 1475/16 FC | 1 | — | — | — | 607.1 SL |
| | 3 | — | — | — | 163.1 N |
| | 4 | 316.0 | 2.5 | 4. | 115.1 SL |
| | 5 | 292.3 | 4. | 7. | 1057.7 N(3) |
| | 6 | 346.0 | 3.5 | 10. | 533.2 N |
| Three-Step | | | | | |

TABLE VI-continued

Effect of Aging Treatment on 1000° F./120 ksi Stress Rupture
Product: 9/16" ϕ Hot Rolled Round

| Heat Treatment °F./hr | Alloy No. | SBL Hrs. | El % | RA % | NBL ($K_t$ = 2) Hrs. |
|---|---|---|---|---|---|
| Ages*** | | | | | |
| 1900/1, AC + | | | | | |
| 1475/12, A | 1 | 156.1(2) | 2.5 | 2. | 105.1 N |
| | 3 | — | — | — | 29. N |
| | 4 | 83.4 | BIT | — | 123.2 SL |
| | 5 | 362.7 | BIT | — | 387.4 SL |
| | 6 | 548.2 | 5.5 | 8. | >575. |
| 1475/16, A | 1 | 732.2 | 2.5 | 9. | 280.4 N |
| | 3 | 161.7 | 2. | 4. | 93.9 N |
| | 4 | 165.7 | 4. | 3.5 | 161.4 N |
| | 5 | 210.6 | 5. | 10. | 1152.6 SL(4) |
| | 6 | 106.6 | 6.5 | 14. | 230.3 SL |

SL = Failed in radius of smooth ligament.
BIT = Broke in threads.
**Aged at Temp/Time Shown Furnace Cooled 100° F./hr to 1150° F./8 hr, AC
***Aged at Temp/Time Shown Air Cooled Plus 1325°/8 hr FC (100°/hr) to 1150°/8 hr, AC
(1)Broke in extreme end threads at center tap.
(2)Broke in extreme end threads at center tap at 153.3 hrs, reloaded.
(3)Stress inc. to 125 ksi @ 1037 hrs, inc. to 130 ksi @ 1057.7 hrs.
(4)Stress inc. to 125 ksi @ 1078 hrs, inc. to 5 ksi/8-12 hrs to 155 ksi.
(5)Stress inc. to 125 ksi @ 1000 hrs, inc. to 5 ksi/8-12 hrs to 140 ksi.
(6)Stress inc. to 125 ksi @ 1032 hrs, inc. to 5 ksi/8-12 hrs to 135 ksi.

TABLE VII

| Heat No. | C | Mn | Fe | S | Si | Cu | Ni | Cr | Al | Ti | Co | Mo | Cb + Ta | B |
|---|---|---|---|---|---|---|---|---|---|---|---|---|---|---|
| A | .01 | .05 | Bal | .003 | .17 | <.01 | 38.69 | .02 | .93 | 1.10 | 13.91 | <.01 | 3.16 | .0012 |
| B | .02 | .05 | Bal | .003 | .16 | <.01 | 39.07 | .01 | 1.03 | 1.51 | 12.91 | <.01 | 3.11 | .0020 |
| C | .01 | .04 | Bal | .003 | .12 | <.01 | 38.82 | <.01 | 1.03 | 1.45 | 13.56 | <.01 | 3.01 | .0088 |
| 10 | .01 | .05 | Bal | .003 | .17 | <.01 | 37.40 | .07 | .030 | 1.51 | 14.17 | <.01 | 4.87 | .0014 |
| 11 | <.01 | .05 | Bal | .004 | .17 | <.01 | 37.62 | .07 | .044 | 1.51 | 13.42 | <.01 | 5.03 | .0026 |
| 12 | .01 | .05 | Bal | .003 | .16 | <.01 | 37.34 | .07 | .040 | 1.53 | 14.35 | <.01 | 4.90 | .0084 |

TABLE VIII

Product: 9/16" Dia. Hot Rolled Round
Heat Treat: Anneal: 1900° F./1 hr, Cool as Indicated
Codes: FC*: Furnace cooled 50° F./hr to 1100° F./air cooled.
FC**: Furnace cooled 100° F./hr to 1150° F./8 hr, air cooled
AC: Air cooled.

| | | 1000° F. Rupture Properties | | | | |
|---|---|---|---|---|---|---|
| | | Initial | Smooth Bar | | | $K_t = 2$ Notch Bar |
| Heat No. | Heat Treat | Stress ksi | Life Hrs. | El % | RA % | Life Hrs. |
| A | 1900/1, AC + 1475/8 FC** | 100 | 7.5 | 4.5 | 8. | 3.1 |
| B | 1900/1, AC + 1475/8 FC** | 100 | 8.4(1)BIT | | | 4.4 |
| C | 1900/1, AC + 1475/8 FC** | 100 | 5.2(1)BIT | | | 8.4 |
| 10 | 1900/1, AC + 1475/8 FC** | 100 | 1412.6D(6) | | | 940.2(2) |
| 11 | 1900/1, AC + 1475/8 FC** | 100 | 1411.8D(6) | | | 1316.8(3) |
| 12 | 1900/1, AC + 1475/8 FC** | 100 | 913.(1)BIT | | | 742.4 |
| 10 | 1900/1, FC* + 1425/8 FC** | 100 | 1130.9D | | | 800.1 |
| 11 | 1900/1, FC* + 1425/8 FC** | 100 | 1130.5D | | | 811.8(5) |
| 12 | 1900/1, FC* + 1425/8 FC** | 100 | 1130.4D | | | 239.6 |
| 10 | 1900/1, AC + 1400/16, AC + 1325/8 FC** | 120 | 350.1 | 3. | 4. | 180.6 |
| 11 | 1900/1, AC + 1400/16, AC + 1325/8 FC** | 120 | 129.1 | 1. | 0. | >194.5(4) |
| 12 | 1900/1, AC + 1400/16, AC + 1325/8 FC** | 120 | 58.4 | 4. | 8. | 144. |

(1)BIT — Broke in threads.
(2)Stress inc. to 110 ksi at 840 hrs.
(3)Stress inc. to 110 ksi at about 940 hrs.
Stress inc. to 120 ksi at about 1200 hrs.
Stress inc. to 130 ksi at about 1300 hrs.
(4)Broke in smooth ligament
(5)Stress inc. to 110 ksi at 800 hrs.
(6)Stress inc. to 110 ksi at about 800 hrs.
Stress inc. to 120 ksi at about 1340 hrs.
Stress inc. to 130 ksi at about 1400 hrs.
D — Discontinued Alloys in accordance with the invention are producible by usual production means such as vacuum induction melting, vacuum arc remelting and other combinations. Ingots up to 30-inches in diameter have been produced in Alloy No. 2. The alloy is readily weldable by methods such as electron beam welding, TIG, etc. It seems to be important in terms of avoidance of segregation in the ingot, weldability, hot workability, etc. to limit the total hardener content as expressed by the relationship Ti+columbium divided by 2 not to exceed 4.5, and preferably not to exceed 4.

Since the alloys of the invention are essentially free of chromium, many differences exist in comparison to chromium-containing alloys of the same hardener content. The compositions of the equilibrium phases are believed to be different and the failure mechanism under stress is distinctly different.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for providing elevated temperature notch strength in wrought products made of an alloy consisting essentially of about 34% to about 55% nickel, about 5% to about 25% cobalt, about 1.5% to about 5.5% columbium, about 1% to about 2% titanium, no more than 0.2% aluminum, up to about 0.1% carbon and the balance essentially iron, said columbium being replaceable by tantalum on the basis of two parts of tantalum for each part of columbium by weight, which comprises annealing said product at a temperature of about 1650° F. to about 1925° F. and then heating said annealed product in an intermediate temperature range of about 1375° F. to about 1550° F. for a time sufficient to overage said product, with the proviso that said intermediate temperature and time are upwardly graduated as the annealing temperature is increased, said temperature and time relationship being equivalent to at least 8 hours at the intermediate temperature of 1425° F. when the annealing temperature is 1900° F., and then heat treating said product in a lower temperature range of about 1100° F. to 1400° F. for at least 8 hours to provide in said product a notch strength of at least about 100 hours at 1000° F. and 100 ksi.

2. The method in accordance with claim 1 wherein said intermediate temperature treatment is conducted at a temperature of at least about 1425° F. and for more than 8 hours when said annealing treatment is conducted at a temperature of at least 1800° F.

3. The method in accordance with claim 1 wherein the product is slowly cooled from the intermediate temperature to a temperature within the lower temperature range.

4. The method in accordance with claim 3 wherein the cooling rate is about 20° F. per hour to 200° F. per hour.

5. The method in accordance with claim 1 wherein the annealed product is heated isothermally in the intermediate temperature range, is slowly cooled to a temperature in the lower temperature range and is then isothermally treated.

6. The method in accordance with claim 1 wherein the product is air cooled from the intermediate temperature and is thereafter subjected to two-step aging treatment in the lower aging temperature range wherein the temperature of the first step is at least about 100° F. higher than the temperature of the second step.

7. A controlled expansion age hardened alloy consisting essentially of about 34% to about 45% nickel, about 5% to about 25% cobalt, about 1.5% to about 5.5% columbium, about 1% to about 2% titanium, not over about 0.2% aluminum, not over about 0.1% carbon, up to about 1% vanadium, up to about 2% hafnium, up to about 0.03% boron and the balance essentially iron, with the proviso that tantalum may be substituted for columbium on the basis of two parts of tantalum for each part of columbium by weight, said alloy being in the heat treated condition which includes an overaging treatment at a temperature in the range of about 1375° F. to about 1550° F. and being characterized by a notch strength of at least about 100 hours at 1000° F. and 100 ksi.

8. A wrought product made of a controlled expansion age hardened alloy consisting essentially of about 34% to about 45% nickel, about 5% up to about 25% cobalt, about 1.5% to about 5.5% columbium, about 1% to about 2% titanium, not over about 0.2% aluminum, not over about 0.1% carbon, up to about 1% vanadium, up to 2% hafnium and the balance essentially iron, with the proviso that tantalum may be substituted for columbium on the basis of two parts of tantalum for each part of columbium by weight, said product being in the heat treated condition which includes an overaging treatment at a temperature in the range of about 1375° F. to about 1550° F. and being characterized by a notch strength of at least about 100 hours at 1000° F. and 100 ksi.

9. A wrought product in accordance with claim 8, wherein the cobalt content of the alloy is at least 10%.

10. A wrought product in accordance with claim 8, wherein the cobalt content of the alloy is about 12% to 16%.

11. A wrought product in accordance with claim 8, wherein the boron level of the alloy is up to about 0.03%.

12. A wrought product in accordance with claim 8, wherein the iron content of the alloy is about 20% to about 55%.

13. A wrought product in accordance with claim 8, wherein the $$\frac{Ti + Cb}{2}$$

level in the alloy does not exceed 4.5.

14. A brazed wrought product in accordance with claim 8, wherein the article is annealed at a temperature of about 1900° F.

15. An article of manufacture designed for use at temperatures in the order of 1000° F. made from the heat treated alloy of claim 7.

16. The method in accordance with claim 1, wherein the alloy contains up to about 45% nickel.

17. The method in accordance with claim 1, wherein the alloy contains up to about 0.03% boron.

18. A wrought product made of a controlled expansion age hardened alloy consisting essentially of about 34% to about 55% nickel, about 5% to about 25% cobalt, about 1.5% to about 5.5% columbium, about 1% to about 2% titanium, not over about 0.2% aluminum, not over about 0.1% carbon and the balance essentially iron, with the proviso that tantalum may be substituted for columbium on the basis of two parts of tantalum for each part of columbium by weight, said product being in the heat treated condition which includes an overaging treatment and being characterized by a notch strength of at least about 100 hours at 1000° F. and 100 ksi, and said product being made by the method of claim 1.

* * * * *

REEXAMINATION CERTIFICATE (797th)

United States Patent [19] [11] B1 4,445,944

Smith, Jr. et al. [45] Certificate Issued Dec. 15, 1987

[54] HEAT TREATMENTS OF LOW EXPANSION ALLOYS

[75] Inventors: Darrell F. Smith, Jr.; Edward F. Clatworthy, both of Huntington, W. Va.

[73] Assignee: Huntington Alloys, Inc., Huntington, W. Va.

Reexamination Request:
No. 90/001,202, Mar. 23, 1987

Reexamination Certificate for:

| | |
|---|---|
| Patent No.: | **4,445,944** |
| Issued: | **May 1, 1984** |
| Appl. No.: | **302,975** |
| Filed: | **Sep. 17, 1981** |

[51] Int. Cl.[4] ..... C21D 7/14; C22F 1/10

[52] U.S. Cl. ..... 148/12.3; 148/12.7 R; 148/12.7 N; 148/142; 148/158; 148/162; 148/328; 148/409; 148/410; 148/419

[58] Field of Search ..... 148/12.3, 12.7 R, 12.7 N, 148/142, 158, 162, 409, 410, 419, 328

[56] References Cited

PUBLICATIONS

D. F. Smith, E. F. Clatworthy, D. G. Tipton and W. L. Mankins, "Improving The Notch-Rupture Strength of Low-Expansion Superalloys", published by The American Society of Metals in the Book entitled "Superalloys 1980", Proceedings Of The Fourth International Symposium on Superalloys, pp. 521-530, 1980.

*Primary Examiner*—R. Dean

[57] ABSTRACT

Directed to an overaging heat treatment applied to age-hardenable nickel-cobalt-iron controlled expansion alloys so as to contribute high notch strength at temperatures on the order of about 1000° F. thereto.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 5–18 is confirmed.

Claims 2 and 3 are determined to be patentable as amended.

Claim 4, dependent on an amended claim, is determined to be patentable.

New claims 19–26 are added and determined to be patentable.

2. The method in accordance with claim 1 wherein *said annealing treatment is followed by one of air cooling and furnace cooling and* wherein said intermediate temperature treatment is conducted at a temperature of at least about 1425° F. and for more than 8 hours when said annealing treatment is conducted at a temperature of at least 1800° F.

3. The method in accordance with claim [1] *2* wherein the product is slowly cooled from the intermediate temperature to a temperature within the lower temperature range.

*19. The method in accordance with claim 2 wherein the intermediate treatment is conducted at a temperature of about 1425° F. for about 12 hours.*

*20. The method in accordance with claim 2 wherein the annealing treatment is conducted at a temperature to result in a substantially non recrystallized product.*

*21. The method in accordance with claim 2 wherein the annealing treatment is conducted at a temperature to result in a substantially recrystallized product.*

*22. A method for providing elevated temperature notch strength in wrought products made of an alloy consisting essentially of about 34% to about 55% nickel, about 5% to 25% cobalt, about 1.5% to 5.5% columbium, about 1% to about 2% titanium, no more than 0.2% aluminum, up to about 0.1% carbon and the balance essentially iron, which comprises annealing said product at a temperature of about 1650° F. to about 1925° F., cooling said annealed product in a controlled manner as by air cooling or furnace cooling, heating said annealed product in an intermediate temperature range of about 1375° F. to 1550° F. for a time sufficient to overage said product, with the proviso that the said intermediate temperature and time are upwardly graduated as the annealing temperature is increased, said temperature and time relationship being equivalent to at least about 12 hours at the intermediate temperature of 1425° F. when the annealing temperature is 1900° F., and then heat treating said product in a lower temperature range of about 1100° F. to 1400 F. for at least 8 hours to provide in said product a notch strength of at least about 100 hours at 1000° F. and 100 KSI.*

*23. The method in accordance with claim 22 in which the nickel content is about 34% to 45%, the cobalt is about 12% to 16%, the columbium is about 3.7% to 4.8%, and wherein the alloy product is air cooled from the anneal temperature and the intermediate temperature is conducted at about 1425° F. for about 12 hours.*

*24. The method in accordance with claim 23 in which the alloy product is furnace cooled from the anneal temperature.*

*25. The method in claims 22, 23 or 24 in which the annealing treatment is conducted at a temperature to result in a substantially non recrystallized product.*

*26. The method in claim 22, 23 or 24 in which the annealing treatment is carried out at a temperature to result in a substantially recrystallized structure.*

* * * * *